United States Patent [19]

Fukunaga et al.

[11] 4,281,423

[45] Aug. 4, 1981

[54] FOAM BATHING APPARATUS

[75] Inventors: Masao Fukunaga, Matsubara; Fusao Niino, Suita; Hiroshi Nonoguchi, Yao, all of Japan

[73] Assignee: Matsushita Electric Industrial Co., Ltd., Kadoma, Japan

[21] Appl. No.: 143,345

[22] Filed: Apr. 24, 1980

[30] Foreign Application Priority Data

Apr. 27, 1979 [JP] Japan ..... 54-053107
Apr. 27, 1979 [JP] Japan ..... 54-053108

[51] Int. Cl.[3] ..... A61H 33/06

[52] U.S. Cl. ..... 4/537; 4/535; 4/524; 128/367; 128/66; 128/368; 261/124; 261/DIG. 26; 261/DIG. 78

[58] Field of Search ..... 4/537, 524, 535, 536; 128/66, 200.16, 367, 368; 261/122, 124, DIG. 26, DIG. 78

[56] References Cited

U.S. PATENT DOCUMENTS

| | | | |
|---|---|---|---|
| 1,587,844 | 6/1926 | Landberg | 128/66 |
| 1,922,749 | 8/1933 | Roush | 261/122 |
| 1,950,900 | 3/1934 | McConnell | 261/122 X |
| 2,138,428 | 11/1938 | Pulgar | 4/537 |
| 2,216,791 | 10/1940 | Simjian | 261/122 X |
| 2,601,225 | 6/1952 | Sander | 261/122 |
| 2,715,099 | 8/1955 | Stugart | 261/DIG. 47 |
| 2,774,585 | 12/1956 | Wirts | 261/122 |
| 2,937,506 | 5/1960 | Stirlen | 261/122 X |
| 3,396,950 | 8/1968 | Wood | 261/124 X |
| 3,707,971 | 1/1973 | Yamamoto | 128/368 |
| 3,712,307 | 1/1973 | McLaughlin | 128/368 |
| 3,749,092 | 7/1973 | Wiliams | 4/537 X |
| 3,768,483 | 10/1973 | Kusunoki | 4/537 |
| 3,949,743 | 4/1976 | Shanbrom | 128/368 |
| 4,004,302 | 1/1977 | Hori | 4/543 |

*Primary Examiner*—Henry K. Artis
*Attorney, Agent, or Firm*—Whittemore, Hulbert & Belknap

[57] ABSTRACT

A foam bathing apparatus comprising a main body including a blower, a container mounted on the main body for containing a bath and a porous body disposed at an inner bottom portion of the container. Air from the blower is passed through the porous body to produce numerous air bubbles in the bath for the user to immerse the face or the like in the bath for cleansing or massaging. The apparatus includes a pressure chamber provided within the main body and positioned downstream from the blower in proximity thereto, the pressure chamber being provided with a pressure adjusting assembly comprising, for example, a pressure adjusting aperture and a shutter for opening or closing the aperture for smooth and fine adjustment of the amount of air bubbles to be produced. The apparatus is usable also for cleansing or massaging other part of the human body, such as the hand, elbow or foot.

12 Claims, 14 Drawing Figures

FOAM BATHING APPARATUS

The present invention relates to a foam bathing apparatus for producing numerous air bubbles in a bath for the user to immerse the face, hands, elbows or feet in the bath for massaging or for the removal of dirt and fatty matter, and more particularly to an apparatus comprising a main body having blower means and a container mounted on the main body for containing a bath and provided at its inner bottom portion with a porous body for producing air bubbles.

Various foam bathing apparatus of this type have been proposed as disclosed in U.S. Pat. No. 4,004,302. With the apparatus disclosed in the patent, the generation of foam is adjustable not on the front side of its main body but by releasing air from the top of an inverted U-shaped air channel extending along a hood serving as a bath container. In the case of this construction, the amount of foam to be formed is not smoothly and finely adjustable, while the air released at the outer side of the hood in which the face or the like is placed flows against the face during actual use and feels uncomfortable. Additionally the adjusting means, which is visible from outside, is unsightly. The apparatus has another problem that the porous body for producing air bubbles is not removable from the hood and is therefore difficult to handle for cleaning or maintenance.

The main object of the invention is to provide a foam bathing apparatus in which the amount of air bubbles to be formed is smoothly adjustable and which is free of the above problems.

To fulfill this object, the present invention provides a foam bathing apparatus of the type mentioned above in which the main body is provided in its interior with a pressure chamber for receiving air from the blower means and feeding the air to the porous body, the main body further having means for adjusting the internal pressure of the chamber. With this arrangement, the pressure within the pressure chamber is adjustable smoothly and finely to form air bubbles in an amount in accordance with the adjusted pressure.

According to a preferred embodiment of the invention, the pressure adjusting means comprises means for adjustably releasing air from the pressure chamber, namely, an aperture for releasing air and a shutter for opening or closing the aperture.

According to another preferred embodiment of the invention, an ingeniously shaped packing is used at the connection between the main body and the container to prevent the leakage of air, and the porous body for forming air bubbles is installed in the container also ingeniously with use of an effective sealing member.

These and other objects and advantages of the invention will become more apparent from the description of the preferred embodiments given below with reference to the accompanying drawings, in which.

Figure 2:
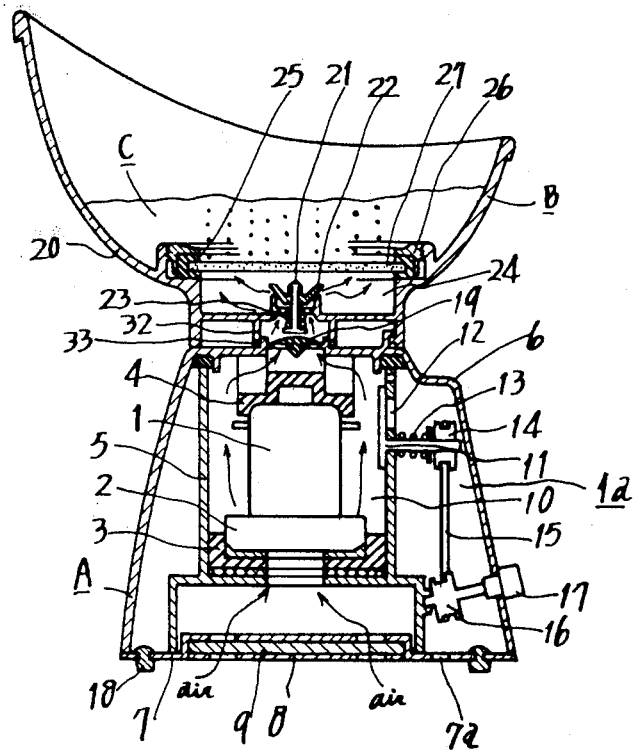
FIG. 2 is a side elevation in vertical section showing the apparatus.
Figure 5:
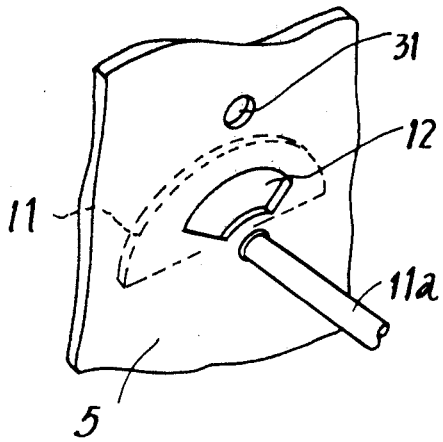
Figure 4A:
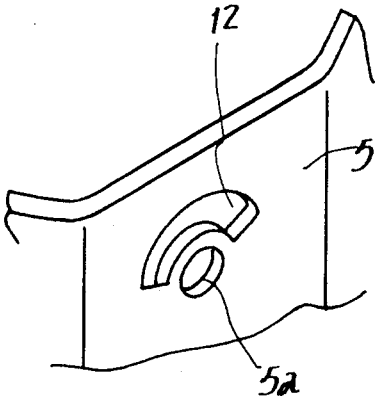
Figure 4B:
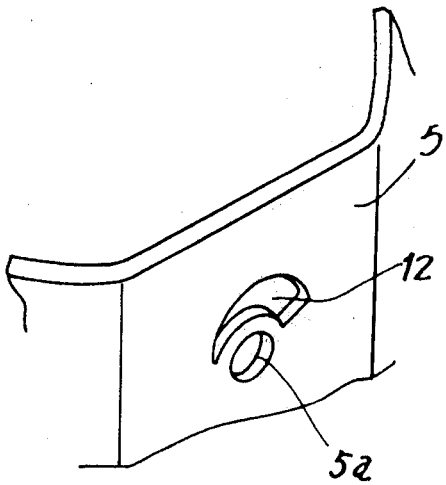
Figure 6:
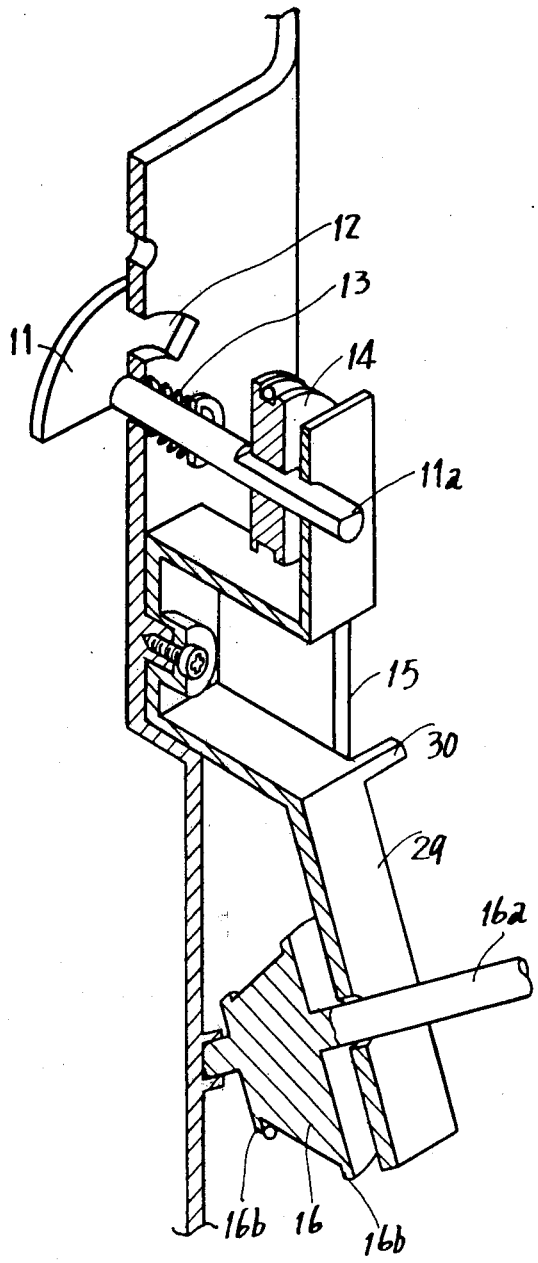
Figure 7:
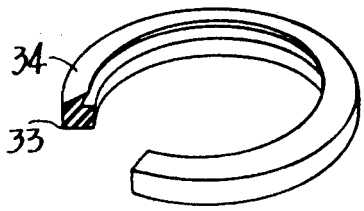
Figure 8:
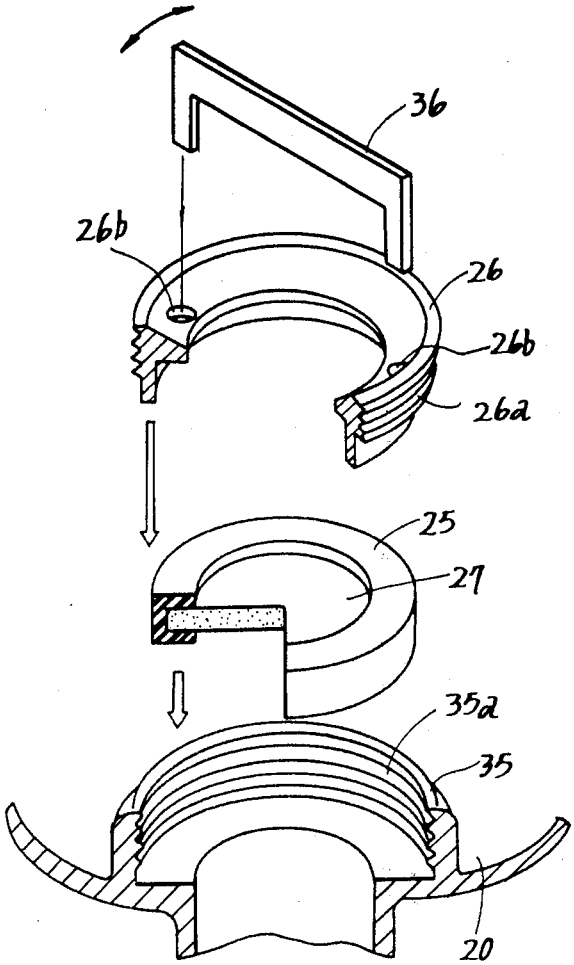
Figure 9:
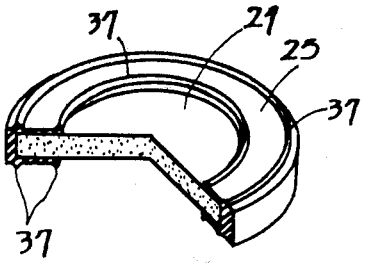
Figure 10:
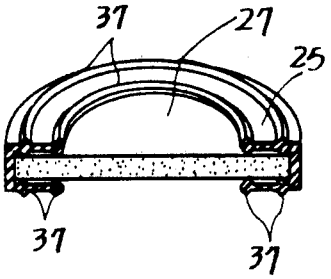
Figure 11:
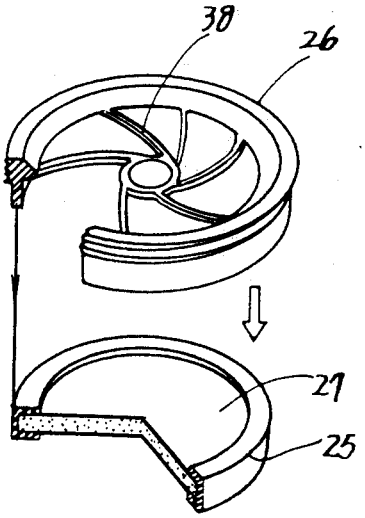
Figure 12:
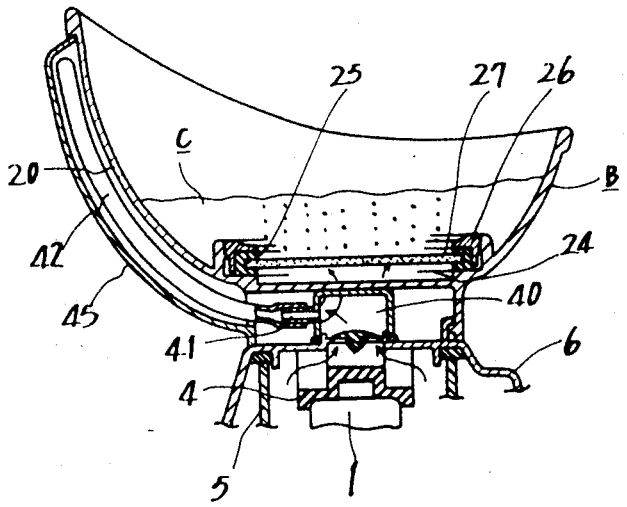
Figure 13:
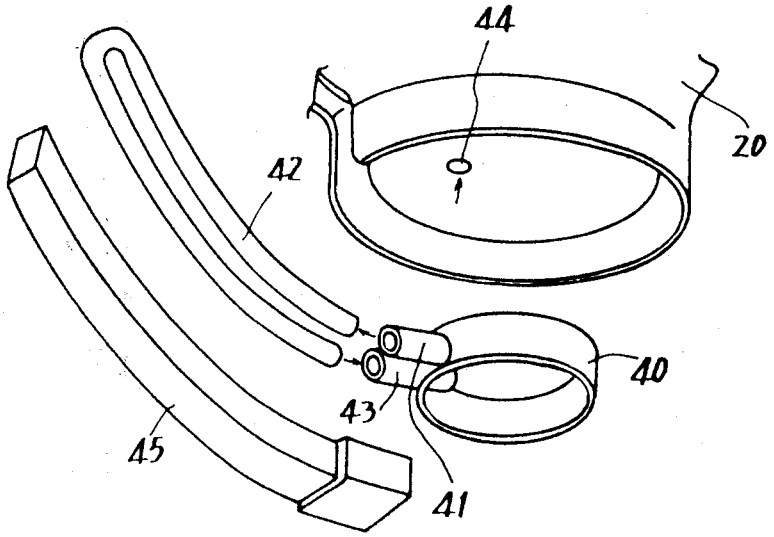

FIGS. 4*a* and 4*b* are perspective views showing pressure adjusting apertures of different shapes useful for the pressure adjusting means;

FIG. 5 is a fragmentary perspective view showing a modification of the pressure adjusting means;

FIG. 6 is a perspective view partly broken away and schematically showing the entire construction of the pressure adjusting means;

FIG. 7 is a perspective view partly broken away and showing a sealing packing between the main body and a hood;

FIG. 8 is an exploded perspective view partly broken away and showing an assembly for mounting a porous body in place;

FIGS. 9 and 10 show different examples of the packing for mounting the porous body;

FIG. 11 is a view similar to FIG. 8 and showing a modified holder for the porous body;

FIG. 12 is a view similar to FIG. 2 and showing a modified embodiment of the invention with its lower portion omitted; and FIG. 13 is a fragmentary exploded perspective view of the embodiment of FIG. 12.

Figure 1:
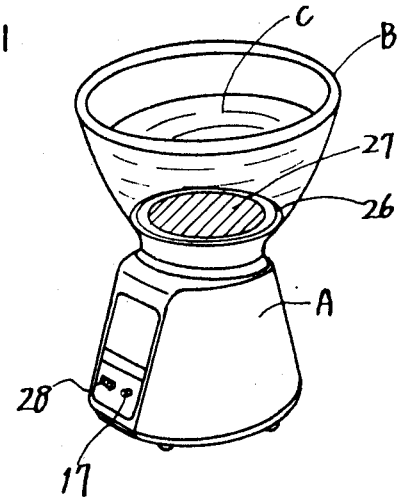
FIG. 1 is a perspective view showing a foam bathing apparatus embodying the invention.

With reference to the foam bathing apparatus shown in FIG. 1, air of high pressure is produced in a main body A incorporating blower means and fed to a container B mounted on the main body A. The air is passed through numerous (about 2,600,000) minute channels, 30 to 50$\mu$ in diameter, of a porous body 27 disposed at an inner bottom portion of the container B and is discharged into a bath C in the container B to form numerous air bubbles in the bath. When rupturing, the air bubbles stimulate, cleanse and massage the skin.

FIG. 2 shows the interior construction of the apparatus. The blower means comprises a motor 1 and a fan 2 attached to the motor and is housed in a motor case 5, as supported by a lower rubber cushion 3 and an upper rubber cushion 4. The motor case 5 is fixedly disposed within the shell 6 of the main body A. With the rotation of the motor 1 which drives the fan 2, air is drawn in upward through an air filter 9 attached to a bottom plate 7 by a holding plate 8 and increases the internal air pressure of a pressure chamber 10 formed by the motor case 5. To adjust the air pressure, the side wall of the case 5 is formed with a pressure adjusting aperture 12 the opening of which is controllable by a shutter 11. The shutter is always held in intimate contact with the motor case 5 by a spring 13 on a shaft 11*a*. The turn of a knob 17 on the outer side of the main body shell 6 is delivered to the shutter 11 through a knob pully 16, belt 15 and shutter pulley 14 fixed to the shaft 11*a*. The pressure adjusting means comprising these members is disposed within the space 1*a* defined by the motor case 5 and the shell 6 except for the shutter 11 and knob 17. Indicated at 18 are rubber legs. The air pressurized in the main body A passes through a main body valve 19 at the upper portion of the main body, pushes up a check valve 22 against the force of a spring 23 and enters a pressure chamber 24 defined by the porous body 27 in the form of a disk and by a hood 20 serving as the container B. The check valve 22 is attached to a stem 21 supported by the hood 20. The pressurized air in the pressure chamber 24 passes through the minute channels of the porous body 27 fastened to the inner bottom of the hood 20 by a holder 26 and produces air bubbles in the bath C within the container B. Indicated at 28 is a switch for the motor 1.

Figure 3:
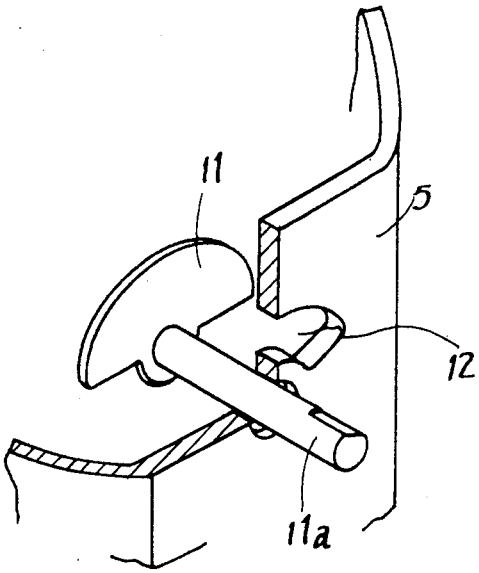
FIG. 3 is a fragmentary perspective view partly broken away and showing pressure adjusting means.

FIG. 3 is an enlarged view showing the pressure adjusting means for controlling the air pressure in the pressure chamber 10 for adjusting the amount of air bubbles to be formed. The air pressure is adjustable by turning the shutter 11 within the motor case 5 involving a minimum pressure loss and releasing part of the air through the pressure adjusting aperture 12. Since the air is released from the chamber having a specified capacity and accommodating the fan 2 or positioned immediately downstream therefrom, the variation of the air pressure is small relative to the quantity of released air, so that the air pressure is finely adjustable. Further because the air is released inside the main body shell 6, the escaping air will sound muffled and will not be released from the apparatus as a blast. FIGS. 4*a* and 4*b* show the shapes of pressure adjusting apertures 12. The aperture of FIG. 4*a* is in the form of a circular arc concentric with a shaft hole 5*a* and having a uniform width, while the aperture of FIG. 4*b* extends with a progressively reducing width toward its one end. The decrease of the air pressure (decrease in the amount of air bubbles formed) is not always in proportion to the open area of the pressure adjusting aperture 12, but when the aperture 12 is tapered as seen in FIG. 4*b* and opened gradually from its tapered end toward the other end, the angle of turn of the shutter is proportional to the variation of the pressure, assuring proportional control of the information of bubbles. As seen in FIG. 5, the motor case 5 has in an upper portion thereof an air release port 31 which is open at all times. The port 31 is about 5 mm in diameter and permits air to escape therethrough at all times. This serves to protect the motor 1 from damage, for example, when the porous body 27 has been clogged up, by causing an increased amount of air to pass by the motor 1 and cool the motor 1. The air escaping from the port 31 passes between the motor case 5 and the main body shell 6 and flows out from the apparatus at a lower portion thereof, for example, through an air vent 7*a* formed in the bottom plate 7 or through an unillustrated cord box.

With reference to FIG. 6, the shaft 11*a* of the shutter 11 and the shaft 16*a* of the pulley 16 are supported by a bracket 29 attached to the outer side of the motor case 5. The pulley 16 is a conical pulley having flanges 16*b* at both ends, while the pulley 14 is an ordinary pulley. Because the side portion of the main body along which the knob 17 is disposed is inclined, the conical pulley 16 is used, with the shaft 16*a* extending therefrom perpendicular to the side portion to carry the knob 17 thereon for moving the pulley 16. The bracket 29 has a projection 30 for guiding the belt 15 against slipping off. The pulley 16 is rough-surfaced to prevent slipping and disengagement of the belt 15.

By releasing air from the motor case 5 with the arrangement described above, the internal pressure of the chamber 10 is finely adjustable with a low noise and without entailing discharge of a sharp air stream for the adjustment of the amount of air bubbles. The deliberate arrangement of the belt and pulleys also assures smooth adjustment with ease. The provision of the air release port 31 for releasing air from the motor case 5 into the space within the main body shell 6 at all times serves to protect the motor 1 from the damage that could result when the porous body 27 has been clogged up and also cool the motor effectively. It is to be noted that such effects are achievable merely by providing the release port.

As illustrated in FIG. 2, the air pressurized in the main body A passes through the valve 19 at the upper portion of the main body A and then through the check valve 22 mounted on the hood 20 and flows into the hood pressure chamber 24 separated by the porous body 27. The check valve 22 is attached to the stem 21 movably supported by the hood and is biased toward its closed position. The container B is detachably attached to the main body A, for example, by a bayonet mount. An annular wall 32 extending downward from the container B in its center bears on a packing 33 mounted on the main body A to prevent leakage of air. As shown in FIG. 7, the packing 33 has an inner lip 34 which is pressed downward by the wall 32 bearing thereon. Even if acting to escape, air will press the lip 34 against the wall 32, which in turn prevents any air leak. The packing of simple construction described thus eliminates air leakage to ensure effective formation of air bubbles.

The porous body 27 is detachably mounted on the hood 20 constituting the container B by engaging a threaded portion 26*a* of an annular holder 26 with a threaded portion 35*a* of a mount 35 upwardly extending from the inner bottom portion of the container B to hold the porous body 27 between the holder 26 and the hood 20 as seen in FIGS. 2 and 8. A packing 25 is fitted around the porous body 27, in contact with its outer peripheral surface and with portions of opposite side surfaces thereof continuous with the peripheral surface. The packing is approximately C-shaped in cross section and made of rubber. Accordingly the porous body 27 is detachable when the holder 26 is removed. This facilitates repair, replacement and assemblage. The holder 26 is made mountable and detachable with greater ease when provided with a projection or bores 26*b* for a tool to engage in so that the holder 26 can be screwed with the projection or tool. Preferably the packing 25 is formed with at least one annular ridge 37 on each of the surface bearing on the bottom of the container B and the surface in contact with the holder 26 as shown in FIG. 9. Like ridges 37 may be provided also on the surfaces thereof in contact with the porous body 27 as shown in FIG. 10.

Since the porous body 27 is covered over its outer peripheral portion with the packing which is approximately C-shaped in cross section, the air passing through the porous body will not leak from the outer peripheral portion to form air bubbles effectively. The packing, when provided with the ridges 37 as in the illustrated examples, produces a more complete sealing effect with a smaller pressing force. The holder 26 which is screwed in to detachably hold the porous body in place greatly facilitates repair, replacement, installation and cleaning of the porous body. The holder 26 can be provided with a cover 38 comprising a plurality of lines and integral therewith as seen in FIG. 11. The cover 38 may be a separate member. The cover 38 protects the upper surface of the porous body 27 from damage. The cover 38, which is made up of linear elements, will not affect the formation of air bubbles noticeably.

The porous body 27 is prepared from fine particles of resin by sintering the particles. The porous body of resin is less costly, less fragile, more amenable to shaping and lighter than ceramic porous bodies.

While FIG. 2 shows an embodiment of the invention, the apparatus of the invention can be modified suitably. FIGS. 12 and 13, for example, shows an embodiment in which the check valve 22 shown in FIG. 2 has been omitted. This embodiment includes a hood 20 having a bottom and a cup-shaped member 40 adapted to receive pressurized air from the body A and provided with a pair of pipes 41, 43. The air passes through the pipe 41, a U-shaped pipe 42 extending along the hood 20 and the other pipe 43 and then enters the hood pressure chamber 24 via an opening 44 formed in the bottom of the hood 20. The check valve 22 can be omitted since the pipe 42 has an intermediate portion at a higher level. Indicated at 45 is a holder for the pipe 42.

What is claimed is:

1. In a foam bathing apparatus having a main body including blower means, a container mounted on the main body for containing a bath, a porous body disposed at an inner bottom portion of the container and passage means for feeding air from the blower means to the porous body, the improvement comprising a pressure chamber provided within the main body and positioned downstream from the blower means immediately adjacent thereto, and means for adjusting the pressure of the chamber.

2. A foam bathing apparatus as defined in claim 1 wherein the pressure adjusting means comprises a pressure adjusting aperture formed in the pressure chamber defining wall and a shutter for opening or closing the aperture.

3. A foam bathing apparatus as defined in claim 2 wherein the pressure adjusting aperture is in communication with the atmosphere through a space between the pressure chamber and the shell of the main body via a lower portion of the main body.

4. A foam bathing apparatus as defined in claim 2 wherein the shutter comprises a plate attached to a rotatable shaft, and the pressure adjusting aperture extends in the form a circular arc around the rotatable shaft with a progressively reducing width toward its one end.

5. A foam bathing apparatus as defined in claim 2 wherein the shutter comprises a plate attached to a rotatable shaft, and the rotatable shaft is coupled to a knob with a pair of pulleys and a belt, one of the pulleys being a conical pulley.

6. A foam bathing apparatus as defined in claim 1 wherein the pressure chamber defining wall is formed with a port open at all times.

7. A foam bathing apparatus as defined in claim 1 wherein the passage means is provided at the connection between the main body and the container with a packing having a lip.

8. A foam bathing apparatus as defined in claim 1 wherein a packing having an approximately C-shaped cross section is fitted around the porous body in contact with its outer periphery and with portions of opposite sides thereof continuous with the outer periphery, and the porous body is held between the container and a holder screwed in the bottom portion of the container with the packing fitting around the porous body.

9. A foam bathing apparatus as defined in claim 8 wherein the packing has annular ridges on the portions thereof in contact with the holder and the container.

10. A foam bathing apparatus as defined in claim 8 or 9 wherein the packing has annular ridges on the portions thereof in contact with the porous body.

11. A foam bathing apparatus as defined in claim 8 wherein the holder has a netlike cover over the upper surface of the porous body.

12. A foam bathing apparatus as defined in claim 1 wherein the porous body is prepared from synthetic resin.

* * * * *